United States Patent [19]

Bayer

[11] Patent Number: 4,507,653

[45] Date of Patent: Mar. 26, 1985

[54] ELECTRONIC SOUND DETECTING UNIT FOR LOCATING MISSING ARTICLES

[76] Inventor: Edward B. Bayer, P.O. Box 7738, Johannesburg, South Africa

[21] Appl. No.: 625,820

[22] Filed: Jun. 28, 1984

[30] Foreign Application Priority Data

Jun. 29, 1983 [ZA] South Africa ..... 83/4738
Jul. 26, 1983 [ZA] South Africa ..... 83/5445

[51] Int. Cl.[3] ..... G08B 1/08; G10K 11/00

[52] U.S. Cl. ..... 340/539; 340/571; 340/573; 340/825.36; 340/825.49; 340/825.72; 367/198; 367/199

[58] Field of Search ..... 340/539, 531, 568, 571, 340/572, 573, 692, 825.36, 825.49, 825.69, 825.72, 825.39, 384 E, 384 R; 367/197, 198, 199

[56] References Cited

U.S. PATENT DOCUMENTS

| | | | |
|---|---|---|---|
| 3,798,600 | 3/1974 | Saikaishi et al. | 367/199 |
| 3,855,575 | 12/1974 | Leuschner et al. | 367/199 |
| 3,970,987 | 7/1976 | Kolm | 367/199 |
| 4,101,873 | 7/1978 | Anderson et al. | 340/539 |
| 4,322,718 | 3/1982 | Faierstain | 367/197 |

*Primary Examiner*—Donnie L. Crosland

*Attorney, Agent, or Firm*—Saidman, Sterne, Kessler & Goldstein

[57] ABSTRACT

A miniature, battery-operated electronic unit adapted to be attached to a common article such as keys or eyeglasses. The unit is responsive to a plurality of sounds for emitting audible tones to enable a misplaced article to be located. A sound detecting and indicating circuit provides the audible tones upon receipt of a sequence of sounds falling within predetermined frequency, time spacing and amplitude ranges. The correct sequence of sounds is generated by the user by clapping, whistling or making any other loud sounds, and no additional transmitting device is required. Improper sequences of sounds are prevented from producing false activation of the unit. Extremely low power consumption, resulting in part from CMOS technology, allows the unit to remain on continuously for a period of six to nine months using standard camera (button cell) batteries. Special battery-saver circuitry prolongs battery life. The unit can be fabricated using gate array or custom chip technology, which results in extremely small size and low cost of manufacture. A visual indicator (270) allows the user to learn proper operation.

28 Claims, 11 Drawing Figures

FIG. 2
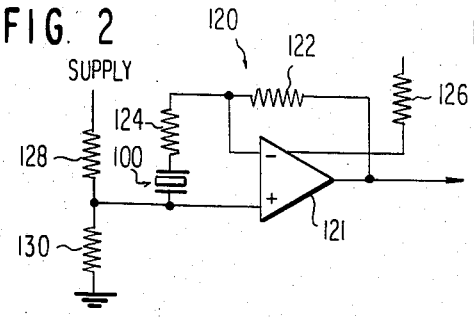
FIG. 3A
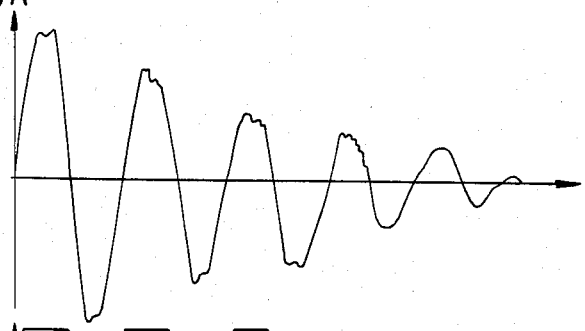
FIG. 3B
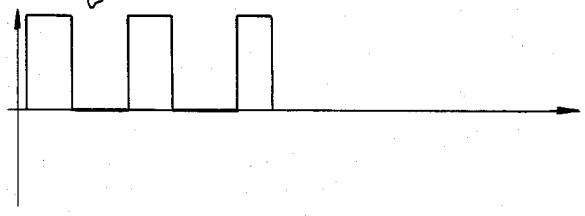
FIG. 4
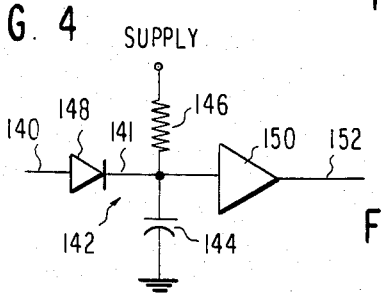
FIG. 3C
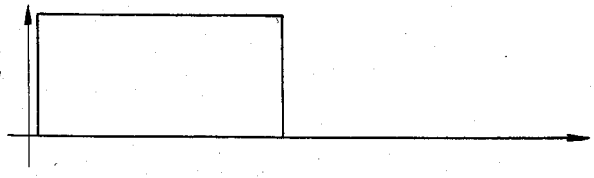
FIG. 5A
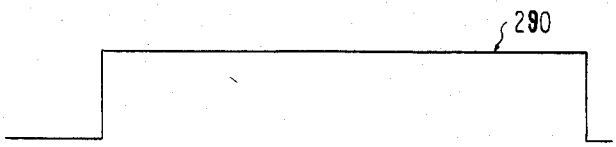
FIG. 5B
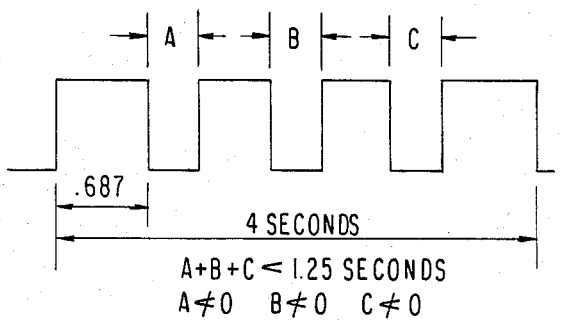
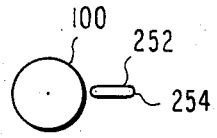
FIG. 6
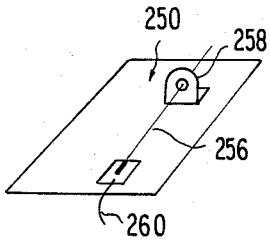
FIG. 7
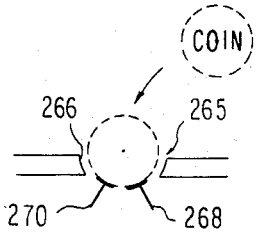
FIG. 8

ELECTRONIC SOUND DETECTING UNIT FOR LOCATING MISSING ARTICLES

BACKGROUND OF THE INVENTION

1. Field of Use

The present invention relates generally to devices and methods used to locate misplaced or lost articles and, more particularly, to an electronic sound detecting and indicating circuit which produces an auditory response upon detection of a sequence of sounds having frequencies, time spacing and amplitude levels falling within predetermined ranges.

2. Related Art

Everyone, at one time or another, has temporarily misplaced his or her keys, eyeglasses, wallet, or the like. Who among us has not experienced the frustration of being unable to find his keys, which he just had a moment or two ago? Who among us has not spent valuable time rummaging through clothes, desks, dressers, drawers, purses, and the like, in a frustrating attempt to locate a misplaced object? Articles such as eye-glasses, keys and the like, are misplaced with great frequency, and consequent inconvenience and frustration to the individual. It would be highly desirable, therefore, if an inexpensive, reliable, and practical device could be provided to assist all of us who, at one time or another, have experienced this.

I am aware of one previous United States patent which teaches a device for locating commonly misplaced objects. U.S. Pat. No. 4,101,873 to Anderson et al. teaches a receiver that is attached to a commonly misplaced object. The user determines the location of the misplaced object by generating a predetermined code transmission using a transmitter. The receiver detects the predetermined code signal and provides an audible output if a proper code sequence is detected. International application No. PCT/GB81/00243 similarly discloses a two-device system comprising a short range signal transmitter or "searcher" and a receiver or "locator". Signalling between the two units may be either by ultrasonic or electromagnetic waves.

There are difficulties in the use of a two-device system (transmitter and receiver) in that, in order to find the object, the transmitter must be available and, hence, it must be located or fetched first. What does one do if one cannot find one's transmitter? A two-device system is also likely to be more expensive than a one-device system.

In addition, the problems associated with radio receivers of the type disclosed by the U.S. Patent and PCT application noted above are numerous. They require complex filters, R. F. oscillators, mixers and tuning networks. Many such items cannot be integrated (such as the tuning coils). Hence, integration of the elements into a cheaper and more easily assembled unit cannot be done. This renders such systems fairly expensive and out of the range of the ordinary consumer.

The present invention overcomes the above-noted disadvantages by providing a single electronic unit which may be easily fabricated on a microchip thereby reducing the cost of mass production, increasing reliability, and eliminating the vagaries associated with a transmitter-receiver system. As will be explained more fully below, the present invention comprises a single self-contained unit which does not require a separate transmitter. The present invention is responsive to human-generated sounds so that a person may locate his missing keys, for example, by simply clapping his hands.

SUMMARY OF THE INVENTION

The foregoing and other objects are achieved in accordance with one aspect of the present invention through the provision of an apparatus which comprises a miniature, battery-powered electronic unit adapted to be attached to a common article such as keys or eyeglasses and including means responsive to a plurality of sound signals for emitting audible signals to enable the common article to be located. The means comprises transducer means responsive to the sound signals for generating first signals, signal processing means connected to the transducer means for providing a binary pulse when each of the first signals exceeds a preselected threshold level, and detector means, connected to the signal processing means, for producing an output signal when a plurality of the binary pulses is received by the detector means within a first predetermined time period.

The detector means may further include means requiring two successive binary pulses to be spaced apart by a second predetermined time period in order for the output signal to be produced. Output means connected to the detector means and the transducer means may also be provided for generating second signals for a third predetermined time period upon receipt thereby of the output signal. The second signals are preferably generated intermittently for the third predetermined time period. The transducer means is also responsive to the second signals to generate the audible signals, and the latter are of a preselected frequency.

In accordance with another aspect of the present invention, the plurality of sound signals is preferably four, and the sound signals preferably comprise human hand claps. The duration of the binary pulse is substantially equal to the period that the first signals exceed the threshold level, and the transducer means is preferably responsive to those of the sound signals that fall within a predetermined frequency range.

In accordance with another important aspect of the present invention, the detector means further comprises disable means for inhibiting the provision of the first signals to the signal processing means for a fourth predetermined time period when two consecutive binary pulses occur too closely together, i.e., within a fifth predetermined period. The second time period is preferably greater than the fifth time period.

The detector means also preferably includes means for detecting a predetermined amount of physical movement of the unit and providing a movement signal thereupon. The disable means which inhibits the provision of the first signals to the signal processing means is operative when the movement signal occurs within the fifth predetermined time period after one of the binary pulses.

Thus, the present invention provides an electronic unit which allows a user to locate the unit by manually creating sound signals (e.g., hand claps) having frequencies, amplitudes and spacings falling within preselected ranges. Upon detection of a correct sound signal sequence, the unit switches from its "listening" mode to an audible mode wherein an audible signal is generated for a predetermined time, thereby allowing the user to determine the location of the unit. By attaching the unit to commonly misplaced articles, the user may find them without requiring a second unit such as a transmitting device. As a result of its small size, very low power consumption, and low manufacturing costs, any commonly misplaced item can be economically provided with its own unit.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 2 is a schematic diagram of a preferred embodiment of amplifier 120 of FIG. 1;

FIG. 3A is a graph of the output of amplifier 120 for a typical hand clap where the vertical axis represents amplitude and the horizontal axis represents time;

FIG. 3B is a graph of the output of Schmitt trigger 138 for a typical hand clap where the vertical axis represents amplitude and the horizontal axis represents time;

FIG. 3C is a graph of the output of envelope shaper 142 for a typical hand clap where the vertical axis represents amplitude and the horizontal axis represents time;

FIG. 4 is a schematic diagram of a preferred embodiment of envelope shaper 142;

FIG. 5A is a graph of a predetermined time period in which a correct sequence of sounds comprising four hand claps or the like must occur, where the vertical axis represents the state of the timing period and the horizontal axis represents time;

FIG. 5B is a graph of the range of the required time periods between successive hand claps of a correct sequence of four claps, where the vertical axis represents the state of the timing period and the horizontal axis represents time;

FIG. 6 is a top plan view of one embodiment of a bump switch 250;

FIG. 7 is a perspective sketch of another embodiment of bump switch 250; and FIG. 8 is a side view, partially broken, of a switch 265.

DETAILED DESCRIPTION OF THE PREFERRED EMBODIMENT

I. General Operation

Figure 1:
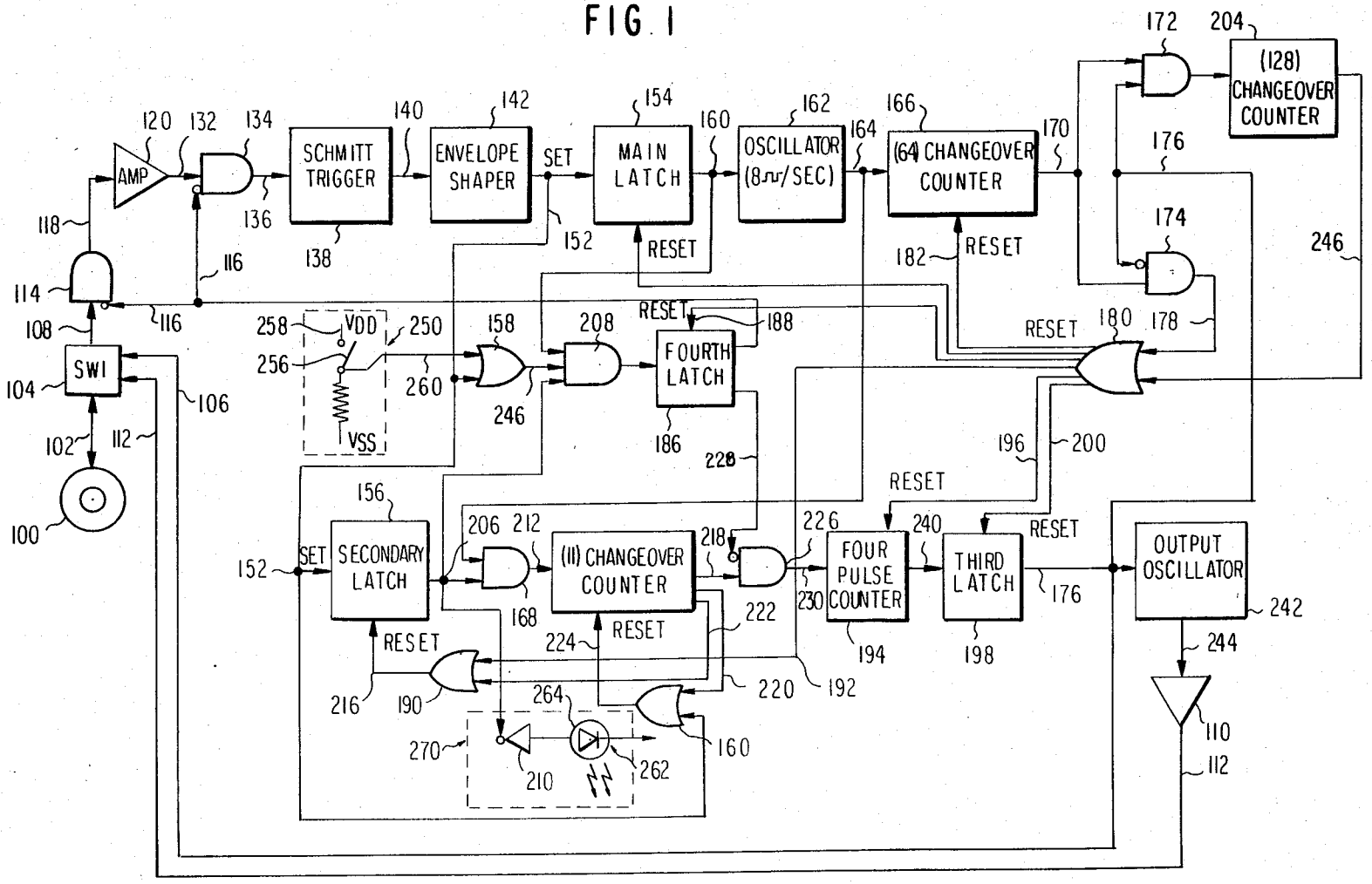
FIG. 1 is a detailed block diagram of a preferred embodiment of the circuit of the present invention.

Broadly, the present invention comprises an electronic article locating unit which allows a user to locate a missing article to which the unit is attached by the user creating a sequence of sounds having a frequency-(ies), amplitude(s), and spacing(s) falling within preselected (or predetermined) ranges. The detection of a correct sound sequence causes the unit to switch into an audible mode allowing the user to determine its location.

The unit of the present invention can be attached to any object. Examples are numerous and include keys, eyeglasses, billfolds, credit card holders, address books, passports, daily schedule books, and so on. Because of the extremely small size of the present invention, it can be attached to or made part of commonly misplaced objects or items whose location can be determined by the user after he or she creates (e.g., by hand clapping) a correct sequence of sounds.

The electronic unit of the present invention runs continuously (except when an external disturbance is detected, which is discussed in detail below). Continuous operation is possible due to the very low power consumption of the unit in its quiescent mode. By being on continuously, the unit is able to detect a correct sound sequence at any time. Upon detection of a correct sound sequence, the present invention switches to its audible mode to generate and emit audible sounds allowing the user to determine its location. The very low power consumption results from the CMOS technology, the electro-mechanical design, and the method of operation of the circuitry of the present invention. Typical power consumption in the quiescent mode is eight to twenty microamps, allowing continuous operation to occur for six to nine months using miniature button cell batteries. Intermittent operation would obviously further conserve power.

The correct sound sequence for activating the unit is selected so that it can be readily created by the user (with little or no training) and yet be sufficiently different from the sounds normally encountered in the environment so as to prevent false triggering. The unit can operate effectively by detecting two or more sequential sounds created by the user. In a preferred embodiment, four such sounds are required. These sounds need to have frequency components which fall within a preselected frequency spectrum, a spacing which falls within minimum and maximum predetermined time intervals, and an amplitude(s) which exceeds a preselected level. A preferred correct sound sequence for properly activating the unit of the present invention comprises four sequential hand claps (or whistles or other loud sounds), which are spaced approximately one second apart and have an amplitude in the moderately loud range. Hereafter, for convenience, the present invention will be described as being activated by four hand claps, although it will be understood that any suitable loud noise may be employed.

The objective is to allow the unit in its listening mode to continuously monitor ambient sounds and to switch into its audible mode only when it detects the correct sound sequence produced by the user. Upon detection of this correct sound sequence, the unit will then emit audible tones which will allow the user to determine its location.

Since the correct sound sequence can be generated by the user clapping his or her hands, the need for a second device (e.g. transmitter) for determining the location of the missing article is eliminated. If a second device (such as a transmitter or tone generator) were required, the usefulness of the location determining device would be reduced substantially since the likelihood of misplacing the second device would be as greater as the likelihood of misplacing the object to which the device is attached.

In operation, in the listening mode, the input/output transducer of the present invention produces an output signal in accordance with any received sound that falls within the frequency response of the transducer. This output signal is amplified, then amplitude compared in a Schmitt trigger, and then shaped in an envelope shaper. Binary pulses are provided by the envelope shaper when received sounds are within the predetermined frequency spectrum of the transducer and exceed a predetermined amplitude level. The envelope shaper produces a single binary pulse when adjacent high outputs from the Schmitt trigger (which performs the amplitude comparison) are spaced apart in time less than a predetermined amount.

The binary pulses provided by the envelope shaper are supplied to logic circuitry which operates as follows. The first binary pulse begins a first predetermined time period in which four binary pulses must occur in order for the unit to be activated and go into its audible mode. It also begins a second predetermined time period which defines the minimum spacing between successive binary pulses in order for activation to occur. This second predetermined time period prevents sounds which are spaced too closely together from activating the unit. Upon detection of the correct sequence (i.e., preferably four) of hand claps, the logic circuitry causes the unit to switch to its audible mode. In the audible mode, the unit emits a continuous tone or a sequence of intermittent tones for a third predetermined time period which allows the user to locate the unit and, hence, the missing article to which it is attached.

Certain non-user generated ambient or environmental sounds and noise bursts must be taken into account in order to obtain long term battery life. The amplification in the amplifier and the amplitude comparison in the Schmitt trigger each consumes considerable power relative to quiescent operation due to the operating point swings caused by such "incorrect" sounds. Thus, when binayr pulses are detected having a spacing less than a minimum predetermined spacing (referred to herein as the "fifth predetermined time interval"), the unit turns itself off and becomes "deactivated" for a "fourth" predetermined time interval. This deactivation increases battery life significantly since the unit is not in its listening mode for most of the time when it is located in an environment where such "incorrect" sounds are present.

The unit of the present invention is also deactivated for the fifth predetermined time period when a physical movement of the unit is detected after detection of a binary pulse. This ability to sense physical movement prevents the unit from consuming excess power due to physical vibrations or disturbances which cause the transducer (which is highly sensitive) to generate signals as if a sound had been detected. Thus, the unit can be carried in the pocket of the user, for example, and not be improperly activated by walking or running.

Proper operation of the unit can be learned by the user through the use of a visual indicator (such as an LED). The visual indicator, for example, can be turned off upon the detection of each binary pulse that is properly spaced from the preceeding binary pulse. This allows the user to learn the proper spacing of hand claps needed to activate the unit. In other words, the user learns the correct spacing by turning off the visual indicator in a sequence that results in generation of the audible tones. This visual indicator can also be used to learn the required amplitude level of a clap that can be detected by the unit. It also allows the user to determine if the unit is operating in its listening mode (which means, among other things, that the battery is not dead). A switch is preferably provided which allows the user to activate the visual indicator; for normal operation it is deactivated because of the considerable battery power that would otherwise be consumed.

II. Curcuit Description

Turning now to the figures and particularly to FIG. 1, there is illustrated a block diagram of a preferred circuit of the present invention wherein most of the components can be manufactured on an integrated circuit microchip using CMOS technology. A transducer 100 provides a signal on a line 102 in accordance with sound received by the transducer. In addition, transducer 100 will emit an audible tone of a preselected frequency in accordance with a signal received from line 102. Thus, transducer 100 operates in two modes: listening (receiving), and audible (transmitting). A preferred form for transducer 100 is a piezoelectric sensor. Such a piezoelectric sensor exhibits a pure capacitance as its impedance is of a very high value. Alternately, a moving field transducer could be used.

When a piezoelectric sensor is used for transducer 100, it not only provides a signal on line 102 in accordance with the received sound, but also acts as a filter since its frequency response is non-linear. This allows a piezoelectric sensor to be chosen which provides an output for the frequency component(s) of sounds within its passband and filters out or blocks all other frequency components. A typical frequency response spectrum is 1000 to 2500 Hertz. This filtering response improves the ability of the unit of the present invention to detect a "correct" sound sequence.

Line 102 is connected to an electronic switch 104. The switching state of electronic switch 104 is controlled by a control signal provided on a control line 106. When there is no control signal on line 106, control switch 104 passes the signal on line 102 to a line 108. Conversely, when a control signal is present on line 106, the output of an output buffer 110 is provided to transducer 100 via a line 112, switch 104, and line 102. In this audible mode, an output signal provided by output buffer 110 causes transducer 100 to emit an audible tone to enable the user to locate the unit. Note that in the audible mode, none of the output signal on line 112 is provided by switch 104 to line 108.

Transducer 100 is a very sensitive device. For example, if it is dropped, it will generate a high energy and voltage spike. In order to prevent damage to the remainder of the circuitry, transducer 100 has back-to-back diodes (not shown) connected to it to prevent damage when the unit is operating in either its listening or audible mode. This will also eliminate static electricity damage to the remainder of the circuit.

Line 108 is connected to an AND gate 114 (if present) or via a line 118 to an amplifier 120 (if AND gate 114 is not present). An inverting input or AND gate 114 is connected to a deactivation line 116. Normally, the signal on line 116 is in a low state, which causes AND gate 114 to provide as its output (line 118) the signal(s) on line 108. As discussed below, AND gate 114 isolates the output of transducer 100 from the input of amplifier 120 when the unit is in a noisy environment of when physical movement is detected.

Amplifier 120 amplifies the low level received signal (typically six to ten millivolts) at its input (line 118) and supplies an amplified signal on a line 132. A preferred form for amplifier 120 is an operational amplifier as shown in FIG. 2. Amplifier 120 operates in the DC mode as a voltage follower and in the AC mode as a fixed gain amplifier.

With respect to the DC mode, a voltage divider comprising a resistor 128 and a resistor 130 is connected to the noninverting input and a resistor 124 in series with transducer 100 is connected between the noninverting input and the inverting input of operational amplifier 121. When transducer 100 is a piezoelectric sensor, it is entirely capacitive and exhibits an infinite impedance. A feedback resistor 122 is connected between the output and the inverting input. A bias resistor 126 is connected to the supply voltage (not shown). This voltage follower configuration makes the DC operation virtually independent of process variations such as offset voltage and open loop gain of the integrated circuit chip. This is very important since such process variations, if uncompensated, would be large enough to mask out the low level input signal, which typically is between six to ten millivolts. In other words, a typical amplifier produced by the preferred CMOS technology has a quiescent point which can vary from chip to chip such that the signal provided by the transducer 100 will be less than the signal variation produced by the process variations.

In the AC mode, the fixed gain is in accordance with the following equation:

$$AC_{gain} = 1 + \frac{R_{122}}{R_{124} + Z_p} \quad \text{(equation 1)}$$

where, $R_{122}$ is the impedance of the feedback resistor 122;

$R_{124}$ is the impedance of resistor 124; and $Z_p$ is the impedance to transducer 100.

The voltage divider network sets the steady state output voltage at a fixed percentage (for example, 20%) of the supply voltage. A typical fixed gain is approximately 250. Thus, for example, a six-millivolt (peak-to-peak) input signal will result in a 1.5 volt output signal from amplifier 120.

Turning back to FIG. 1, the output of amplifier 120 is provided to a noninverting input of an AND gate 134 to the inverting input of which is connected line 116. As discussed below, AND gate 134 performs the same function as AND gate 114: it isolates the output of transducer 100 from the remaining portion of the circuit when the unit is in a noisy environment or a physical movement is detected. In other words, it deactivates the circuit. This deactivation can be performed either by AND gate 114 or AND gate 134. On balance, AND gate 114 is preferable since it also eliminates the operating point swings of amplifier 120 that would occur if the output of transducer 100 were supplied to amplifier 120 when the unit was operating in a noisy environment or a physical movement is detected.

The output of AND gate 134 is supplied by a line 136 to the input of a Schmitt trigger 138. Broadly, Schmitt trigger 138 provides an output signal in a high state (typically, 3 volts) when the input signal on line 136 exceeds a preselected level. FIG. 3A shows the output of operational amplifier 120, which is an amplified version of the signal provided by transducer 100, assuming that a single hand clap is the sound picked up by transducer 100. Note that a hand clap produces a succession of sound pulses which consist of very short bursts of sound energy. FIG. 3B shows the output from Schmitt trigger 138 which follows the input sound pulses and produces a "high" pulse for each input sound pulses that exceeds a preselected amplitude level. Note that the hand clap sound decays with time so that the last two or three sound pulses of FIG. A are of insufficient amplitude to activate Schmitt trigger 138.

An envelope shaper 142 is connected to the output of Schmitt trigger 138 via a line 140. FIG. 4 shows a representative circuit for envelope shaper 142 which comprises a capacitor 144 connected from line 141 to electrical ground and a resistor 146, connected from line 141 to the supply voltage. A diode 148 connects line 140 to line 141 and only passes negative signals from Schmitt trigger 138. A buffer amplifier 150 isolates the output on line 141 of envelope shaper 142 from line 152.

Envelope shaper 142 acts as an integrator. The values of resistor 146 and capacitor 144 are selected so that it combines into one binary pulse (FIG. 3C) two or more pulses (FIG. 3B) provided at the output of Schmitt trigger 138 which are spaced in time less than a preselected amount (for example, 0.125 second). The resultant single binary pulse shown in FIG. 3C, therefore, represents a single hand clap. The values of resistor 146 and capacitor 144 are chosen so that the time constant of envelope shaper 142 is not so long as to combine successive sound pulses which are in fact separate and distinct sounds. In other words, high level signals from Schmitt trigger 138 which are separated in time by an amount greater than the preselected amount (0.125 sec.) result in separate binary pulses being provided by envelope shaper 142. In this way, envelope shaper 142 creates a single binary pulse made up of the individual sound pulses due to a hand clap, but also produces successive binary pulses for different sounds which are displaced in time by an amount greater than the preselected amount.

The following logic circuitry, which operates in a binary mode, provides detection of a "correct" sequence of sounds, disregards sequences of sounds not falling within the "correct" time ranges, and disables the circuit for a preselected time period upon detection of a noisy environment or of a physical movement.

Referring again to FIG. 1, the output of envelope shaper 142 is supplied via line 152 to the set input of a main latch 154, to the set input of a secondary latch 156, to one of the inputs of an OR gate 158 and to one of the inputs of an OR gate 160. With respect to main latch 154, a binary pulse on line 152 causes main latch 154 to provide on a line 160 an enable signal which is applied to the input of an oscillator 162. Oscillator 162, upon receipt of the enable signal on line 160, provides on a line 164 an output pulse train of preselected frequency. Preferably, these are square wave timing pulses. A representative example of the frequency of oscillator 162 is eight cycles per second. Depending on the number of gates available in the custom or customized integrated circuit used to fabricate the unit of the present invention, higher or lower pulse frequencies can be used. Oscillator 162 establishes the time frame reference for the operation of the logic portion of the circuit. Preferably, oscillator 162 is an astable multivibrator modelled on the RCA application note ICAN 6267, which is incorporated herein by reference. This circuit requires two resistors and one capacitor external to the chip. This approach makes the frequency of operation of oscillator 162 virtually independent of variations in device transfer voltages, supply voltage and temperature. It is important that these variations be minimized as much as practicable.

As stated above, power consumption is an important factor. In the preferred astable multivibrator approach for oscillator 162, power consumption is a function of the capacitor charging current and the output frequency. As the frequency is increased, the value of the required capacitor is decreased, which results in a concomitant decrease in size and in cost of this capacitor. A reduction in the value of the capacitor reduces the charging current required. Where a gate array is utilized to fabricate the circuit, it may be advisable to increase the frequency of operation of oscillator 162 to, for example, 16, 32, 64 or 128 pulses per second, and then to divide this higher frequency down to produce the eight pulses per second on which the logic portion operates. If these additional gates are available and do not appreciably increase the size of the gate array chip, it would be advisable to increase the frequency since this would reduce the size of the required external capacitor to an even greater extent.

The output of oscillator 162 is supplied via a line 164 to the input of a changeover counter 166 and to one of the inputs of an AND gate 168. Counter 166 performs two functions: it defines the ("first") predetermined time period in which all of the binary pulses corresponding to the hand claps must occur in order for a "correct" sequence of sounds to be detected; and it defines the ("third") predetermined time period of the audible mode after the correct sequence of sounds has been detected.

When oscillator 162, for example, is generating eight pulses per second, counter 166 is set to count sixty-four changeovers. This means that four seconds is the (first) predetermined time period for the occurence of the four binary pulses that comprise the correct sequence of sounds (i.e., four hand claps). This is shown by trace 290 of FIG. 5A.

Counter 166 can take any suitable form. One approach (not shown) is to use a cascaded set of flip-flops. In this way, counter 166 can not only be used to determine when a preselected number of changeovers has occurred, but can also be used as a source of timing pulses for other portions of the logic circuitry.

When counter 166 has detected the predetermined number of changeovers, it provides a pulse at its output which is supplied via line 170 to an input of an AND gate 172 and to an input of an AND gate 174. A line 176 is connected to an inerting input of AND gate 174 and to a noninverting input of AND gate 172. The signal on line 176 is low except when the "correct" sequence of sounds has been detected, which in the preferred embodiment is four, and the sounds are correctly spaced in time.

When four binary pulses have not been detected within the predetermined time period defined by oscillator 162 and counter 166 (as shown in FIG. 5A; in other words, when line 176 is low), AND gate 174 supplies the output pulse from counter 166 via a line 178 to an input of OR gate 180. This begins the reset mode, where the logic portion of the unit is reset so that another correct sequence of sounds can be detected. Specifically, OR gate 180 supplies the pulse from AND gate 174 as a RESET pulse to the RESET input of counter 166 via a line 182, to the RESET input of main latch 154 via a line 184, to the RESET input of a fourth latch 186 via a line 188, to an input of an OR gate 190 vial a line 192, to the RESET input of a four pulse counter 194 via a line 196, and to RESET input of a third latch 198 via a line 200. Each reset pulse causes its associated circuit to be reset.

In operation, the signal on RESET line 178 goes high either (1) when the counter 166 has detected thirty-two pulses from oscillator 162 and four binary pulses have not been properly detected within the first predetermined time period defined by these thirty-two pulses, or (2) after a changeover counter 204 changes state, which occurs after the lapse of the third predetermined time period defining the duration of the audible mode, which is discussed in detail below.

A secondary latch 156 is part of the portion of the logic circuitry used (1) to detect the occurrence of the four binary pulses comprising the correct sequence of sounds, (2) to set the ("second") predetermined minimum time period between successive binary pulses, and (3) to provide a visible output for the user to learn how to properly activate the unit. Upon receipt of a binary pulse on line 152, secondary latch 156 changes state and provides a high signal at its output. This high signal is supplied via a line 206 to an input of an AND gate 208, to an input of AND gate 168, and to an input of an inverting buffer 210. Note that the output of latch 156 stays high until latch 156 is reset. The high signal at the first input of AND gate 168 allows the pulse train from oscillator 162 via a line 212 to be supplied to an input of changeover counter 214. Counter 214 counts a preselected number of changeovers. When this preselected number is reached, counter 214 provides an output signal on lines 218, 220 and 222. Eleven is a representative number of changeovers which sets the minimum time period between successive binary pulses for activation of the unit to occur.

Referring now to FIG. 5B, it is seen that the value of eleven for the changeover counter 214 gives a timing period of four times eleven, which is 44. Recall that sixty-four is the number of changeovers that counter 166 detects. Comparing fourth-four to sixty-four shows that the minimum time for the correct four pulses to occur is 68.7% of the total time of four seconds. In other words, this allows the user an error factor of 31.3% in the timing of the four successive sounds, or about 1.25 seconds out of four seconds. This error in timing between successive sounds is shown by time intervals A, B and C, where $A+B+C<1.25$ seconds and $A<0$, $B<0$ and $C<0$.

In certain situations, the eleven value for counter 214 with 31.3% allowable error may be too high to achieve proper discrimination against random noise pulses. A twelve value for counter 214 may be more suitable for such applications. A twelve value produces only a 25% allowable error. Thus, it can be appreciated that values other than eleven can be selected for counter 214.

After counter 214 has counted eleven changeovers, it outputs a high pulse on lines 218, 220, and 222. The high pulse on line 222 is provided to an input of OR gate 190, which causes secondary latch 156 to be reset. (Secondary latch 156 is also reset when OR gate 180 provides a reset pulse on line 192.) Further, the high pulse on line 220 is supplied via an OR gate 160 and a line 224 to a reset input of counter 214, which causes counter 214 to be reset. Finally, the high pulse on line 218 is supplied via an AND gate 226 (when line 228 is in its normal low state) and a line 230 to the input of a four-pulse counter 194. Thus, counter 214, after counting out eleven changeovers after receipt of a binary pulse by secondary latch 156, supplies a pulse to counter 194 indicating detection of a correct binary pulse as well as resetting itself and secondary latch 156. This resetting allows secondary latch 156 to be able to receive the next binary pulse via line 152, and for the counting of the correct sequence of sounds to take place in the manner set forth above.

As stated above, counter 214 also performs the function of determining receipt of a binary pulse spaced from a preceeding binary pulse by less than the minimum ("second") predetermined time interval. Specifically, if a binary pulse occurs in a time period less than the eleven changeovers detected by counter 214, counter 214 is reset via line 152, OR gate 160, and reset line 224; secondary latch 156, on the other hand, is not reset since secondary latch 156 does not recive a reset pulse on line 216. This operation results in counter 214 beginning its count again, even though it may have counted up to ten changeovers prior to receipt of the reset. This results in an elongation of the time period counted by counter 214, thus preventing the detection of the correct sequence of sounds within the predetermined time period defined by oscillator 162 and counter 166. In this way, counter 214 acts to define the minimum time period between successive sounds that will result in activation (sounding) of the present invention.

As noted above, counter 214 provides on line 218 an output pulse each time it has counted out a time period equal to the preselected number of changeovers, which in the example shown is eleven. This output pulse is supplied to the noninverting input of AND gate 226. Line 228 normally is in the low state (except when a noisy environment is detected or a physical movement occurs as discussed below). Consequently, the pulse on line 218 is supplied by AND gate 226 via line 230 to the four pulse counter 194.

Counter 194 is set to count a predetermined number of input pulses and then provide an output pulse. The number that counter 194 counts equals the number of binary pulses that comprise the correct sequence of sounds which causes the unit to go into its audible mode. In the embodiment shown, this number is four. When four pulses are received on line 230, counter 194 outputs a pulse on line 240, which is provided to an input of third latch 198.

Third latch 198 changes state upon receipt of the pulse on line 240 and provides a high signal on line 106 and on line 176. These high state signals indicate that the unit has been activated. In this audible mode, the unit generates and emits an audible tone(s) allowing the user to determine its location.

Specifically, the audible tone(s) emitted during the audible mode is generated as follows. The high signal on line 176 causes and oscillator 242 to generate an audio signal of preselected frequency. Any type of audio signal can be produced. A preferred form for the audio signal is a serial square wave having a very sharp rise time and fall time. This produces an intermittent and pulsing audible sound. The sharp rise and fall times of the pulses enhance the audible tone to the user.

The output pulse stream of oscillator 242 on a line 244 is supplied to an output buffer 110. Output buffer 110 acts to isolate oscillator 242 from the transducer 100. The buffered pulse train is supplied by output buffer 110 to the transducer 100 via line 112, switch 104 and line 102. Switch 104 allows the signal on line 112 to be supplied to transducer 100 and isolates line 102 from line 108 when line 106 is in the high state. As stated above, line 106 is in the high state when the third latch 198 provides the high signal on line 176 which causes output oscillator 242 to generate the pulse stream.

The duration of the audible mode is predetermined and is controlled as follows. When line 176 goes to the high state, AND gate 174 is turned off and cannot provide the reset signal form counter 176 to the various reset lines connected to OR gate 180. Instead, AND gate 172 becomes enabled. When counter 166 provides its next output pulse, the unit does not return to the state where it can detect a correct sequence of sounds; instead, the correct binary pulses have been detected, and the pulse on line 170 from counter 166 is supplied to a 128-changeover counter 204 via AND gate 172 and line 202. A suitable form for 128-changeover counter 204 is a binary flip-flop. The pulse received on line 202 causes changeover counter 204 to change state. This results in the reset of changeover counter 204, which means that a line 246 connected to its output is in the low state. Consequently, no reset signal is supplied to the various stages by OR stage 180.

Changeover counter 204 stays in this reset state until counter 166 again provides a pulse on line 170. Counter 166 does not provide such a pulse until it has counted out another sixty-four changeovers of the pulse train provided by oscillator 162. Since oscillator 162 generates eight pulses per second, this corresponds to a time period of four seconds. When these four seconds have been counted out, counter 166 again supplies another pulse on line 170, which is supplied by AND gate 172 and line 202 to the changeover counter 204. This pulse causes the changeover counter 204 to change state. This change of state produces a pulse on line 246, which is supplied by OR gate 180 as a reset pulse on lines 182, 184, 188, and 192 to the various stages of the circuitry. As discussed above, this reset pulse acts to return the unit to the state of operation where it can detect the first hand clap of the correct sequence of sounds.

It is thus seen that changeover counter 204, in conjunction with counter 166 and oscillator 162, determines the duration of the audible mode. A suitable predetermined period of the audible mode is four seconds, but it should be understood that the present invention can employ any desired predetermined period. Obviously, battery power is conserved by reducing this predetermined period as well as by the use of audible pulses as opposed to a continuous audible tone.

Two conditions must be detected in order to assure proper operation of the unit and to extend battery life. The first condition is detection of sounds spaced apart less than a (fifth) predetermined time period. This usually occurs when the unit is located in a noisy environment or where periodic sounds are being produced. An example of such an environment is a machine shop or generating plant.

The second condition occurs when the unit is being physically moved, which movement causes the transducer 100 (which is highly sensitive) to generate an output signal. The unit may undesirably detect this movement as if it were a hand clap. This unwanted "bump" condition can occur in many situations. For example, the unit can be carried in the pocket of the user, and walking or running can produce false triggering. Similarly, placement of the unit on a machine that produces periodic movements (such as the dashboard of a motor vehicle) can also produce a false triggering.

Both of these conditions are detected by the unit if they occur within the "fifth" predetermined time period following a binary pulse. Detection of either condition results in deactivation of the unit for a (fourth) predetermined time period. If either condition should occur at a time greater than this fifth predetermined time period, however, the unit will ignore it because such condition is no different than an improper sound that is spaced more than the (second) predetermined time period for a preceding sound. What is important to understand is that by deactivating the unit of the present invention upon detection of either of these conditions, the battery life is extended considerably.

This is achieved by preventing the signals from transducer 100 from changing the operating point of the Schmitt trigger 138 (when AND gate 134 is employed) or the operating point of the Schmitt trigger 138 and the amplifier 120 (when the AND gate 114 is employed). The detection of these unwanted sounds or physical movements causes AND gate 134 or AND gate 114 (depending on which one is used) to prevent the signal on line 108 from being supplied to the remainder of the circuitry. The deactivation produced by AND gate 134 or AND gate 114 prevents the operating point of amplifier 120 and Schmitt trigger 138 (where AND gate 114 is used), or the operating point of Schmitt trigger 138 (where AND gate 134 is used), from being changed. The elimination of this operating point movement in one or both of these stages significantly reduces battery consumption since thse two stages consume a considerable portion of the power needed to operate the unit. It can be appreciated that use of AND gate 114 also eliminates the unwanted change in the operating point of amplifier 120.

Turning now to the first condition of closely spaced sounds, such sounds result in binary pulses being supplied on line 152. These binary pulses are supplied via an OR gate 158 and a line 246 to one of the three noninverting inputs of AND gate 208. The other two noninverting inputs of an AND gate 208 are connected to line 206 (the output of secondary latch 156) and to line 160 (the output of main latch 154). AND gate 208 provides a pulse via a line 248 to the input of the fourth latch 186 when the output of main latch 154 and the output of secondary latch 156 are in the high state and OR gate 158 provides a binary pulse on line 246. This condition occurs when a binary pulse is produced that is spaced from the preceding binary pulse by an amount less than the minimum fifth predetermined time period. This can occur only when a sound is detected which is less than the minimum predetermined time period. It can be appreciated that this could occur not only in a noisy environment, but also when the user claps his or her hands too closely together in time.

The unit can also detect a physical movement greater than a predetermined amount, which is also referred to as a "bump" condition. A bump switch designated generally by reference numeral 250 generates a signal when the unit is moved more than the predetermined amount. The bump switch can take any number of different forms. Representative examples are shown in FIGS. 6 and 7.

Referring now to FIG. 6, it is seen that a ball bearing 252 is disposed in a race 254 that allows it to move between a first position at the end of race 254 and a second position in physical contact with the outer surface of the transducer 100. The knocking of the ball bearing 252 against transducer 100, which occurs when the unit is physically moved, causes transducer 100 to produce an output signal as if it had received a sound. The binary pulse that is produced by the knocking is supplied via line 152 to the OR gate 158.

Alternately, an elongated, electrically conducting member 256 can be disposed with respect to a surrounding metal contact 258, as shown in FIG. 7. Note that one end of conducting member 256 is fixedly attached while the other passes through an opening in metal contact 258. This opening has a minimum diameter greater than the outer diameter of the free end of conducting member 256. Physical movement of the unit causes conducting member 256 to vibrate. If the movement is more than a predetermined amount in a given direction (determined by the orientation of the bump switch 250), conducting member 256 makes a brief electrical connection with some portion of the inner surface of the opening in contact 258. Since conducting member 256 and contact 258 are connected in series with the power source, this momentary connection results in an electrical pulse being provided on a line 260 to an input of OR gate 158. This pulse is provided by OR gate 158 to AND gate 208 via line 246 in the same fashion as if it was a binary pulse. Thus, the detection of a physical movement greater than the predetermined amount will cause the fourth latch 186 to disable the unit if this movement occurs within the fifth predetermined time period after the previous binary pulse.

As stated above, the fourth latch 186 acts to deactivate the unit so that the operating point of Schmitt trigger 138 and, possibly, the operating point of amplifier 120 are not allowed to move and produce unwanted power consumption. The duration of the deactivation is for the fourth preselected time period. One approach for fixing the period of deactivation is to connect the reset input of the fourth latch 186 to one of the outputs of OR gate 180. In this approach, the deactivation period is determined by counter 166. Deactivation occurs for a time period equal to sixty-four minus the number of changeovers that have been detected when the unwanted sound or physical movement is detected. Thus, if the unwanted sound or physical movement occurs after detection of the first binary pulse, for example, it is possible that deactivation can occur for almost four seconds. At the other extreme, if deactivation occurs after detection of the third binary pulse, the time period would be much shorter since counter 166 has very few changeovers before it provides the output pulse on line 170.

A visual indicator stage 270 is also part of the present invention. It comprises an inverting buffer 210 and a visual indicator 262. A preferred form for visual indicator 262 is an LED 264. Inverting buffer 210 is connected via line 206 to the output of secondary latch 156. With this approach, LED 264 is caused to be lighted when the output of secondary latch 156 is in the low state. Receipt of a binary pulse on line 152, as discussed above, causes secondary latch 156 to go to the high state until it is reset via line 216. Thus, for the duration of the time period determined by counter 214, the LED is caused to be turned off. When secondary latch 156 is reset, however, line 206 goes to the low state causing LED 264 to be lighted. It stays lighted until the next binary pulse is received by secondary latch 156.

The user can learn to properly space his or her hand claps to achieve activation of the unit of the present invention by watching the state of LED 264. Specifically, the user activates the visual indicator stage 270, which causes LED 264 to be lighted. Then the user produces the first clap. This causes LED 264 to be turned off. It stays off until counter 214 has counted out the minimum predetermined time period between successive binary pulses (defined by the eleven value for counter 214). After the predetermined time period has been counted by counter 214, secondary latch 156 is reset and LED 264 is again lighted. The user then knows that he or she should make the next clap. If the clap is of a sufficient loudness, this will cause a binary pulse to be provided on line 152, which will set latch 156. This then causes LED 264 to be turned off. In this fashion, the user can learn to space the four required claps in time so as to activate the audible mode. In addition, the user can determine the required loudness level of hand claps in order to have them detected as binary pulses. In this way, the visual indicator stage 270 allows the user to determine proper time spacing of the claps and the minimum loudness level.

As is well known, any device which produces a visual indication consumes considerable power when compared to the normal eight to twenty microamps that are consumed by the present unit in the quiescent stage. In order to minimize power consumption due to the visual indicator stage 270, provision is made to allow the user to turn if off. This can take any form that allows the LED 264 to be disconnected from the inverting buffer 210. One approach is to provide a switch 265 as shown in FIG. 8. In this approach, a metallic object, such as a coin, is inserted in a slot 266 provided in the case of the enclosure of the unit of the present invention. The coin contacts two metallic contacts 268 and 270 which completes a circuit connecting LED 264 to the inverting buffer 210. This connection is maintained as long as the coin is placed properly in the slot 266. In this way, the visual indicating stage 270 only operates when the user desires it to operate. Any suitable type of switch 265 can be employed. The coin slot approach has a particular advantage in that the user cannot forget to turn off the visual indicating stage 270 since the coin will fall out of the slot when the unit is moved. If a normal switch is employed in lieu of the coin slot switch, the user could inadvertently keep the visual indicating means on. This would result in significant shortening of the life span of the battery. The visual indicating stage 270 can also indicate to the user that the battery is still able to provide the needed power to drive the unit and that the unit is on.

In summary, the unit of the present invention is on continuously. Upon detection of a correct sequence of sounds, it switches to the audible mode and produces an audible tone(s), allowing the user to determine its location. The correct sequence of sounds needed to activate the unit must fall within a first predetermined time period set by counter 166. They must be spaced from each other at least by a minimum second predetermined time period set by the counter 214. Unwanted sounds or physical movement of the unit which occur less than a fifth minimum predetermined time period from the preceding binary pulse causes the unit to be deactivated for a fourth preselected time period, thus increasing battery life. A visual indicator stage is provided to allow the user to determine proper operation of the unit. CMOS circuitry is employed which allows the unit to operate continuously for a period of six to nine months on button batteries. The unit of the present invention is extremely small in size and can be fabricated using automated techniques since the circuit that is employed does not require the selection of specific components to make up for process parameters. The present invention thus is a great improvement over the prior art due to its small size, reliable operation, long operating life, and low manufacturing cost.

Obviously, numerous modifications and variations of the present invention are possible in light of the above teachings. It is therefore to be understood that within the scope of the appended claims, the invention may be practiced otherwise than as specifically described herein.

I claim:

1. Apparatus, which comprises:

a miniature battery-powered electronic unit adapted to be attached to a common article such as keys or eyeglasses and including means responsive to a plurality of human-generated sounds for emitting audible tones to enable the common article to be located, said means comprising:

(a) transducer means responsive to said sounds for generating first signals;

(b) signal processing means, connected to said transducer means, for providing a binary pulse when each of said first signals exceeds a preselected threshold level; and (c) detector means, connected to said signal processing means, for producing an output signal when a plurality of said binary pulses is received by said detector means within a first predetermined time period.

2. The apparatus of claim 1, wherein said detector means further includes means requiring successive ones of said plurality of binary pulses to be spaced apart at least by a second predetermined time period in order for said output signal to be produced.

3. The apparatus of claim 1, further comprising output means, connected to said detector means and said transducer means, for generating second signals for a third predetermined time period upon receipt by said output means of said output signal.

4. The apparatus of claim 3, wherein said output means includes means for generating said second signals intermittently for said third predetermined time period.

5. The apparatus of claim 3, wherein said transducer means is further responsive to said second signals to generate said audible tones.

6. The apparatus of claim 5, wherein said audible tones are of a preselected frequency.

7. The apparatus of claim 1, wherein said plurality of sounds is four.

8. The apparatus of claim 7, wherein said sounds comprise human hand claps.

9. The apparatus of claim 1, wherein said plurality of sounds comprise human hand claps.

10. The apparatus of claim 1, wherein the duration of said binary pulse is substantially equal to the period that said first singals exceed said threshold level.

11. The apparatus of claim 1, wherein said transducer means is responsive of said sounds within a predetermined frequency range.

12. The apparatus of claim 1, wherein said detector means further comprises disable means for inhibiting the provision of said first signals to said signal processing means for a fourth predetermined time period when two consecutive binary pulses occur within a fifth predetermined time period.

13. The apparatus of claim 12, wherein said detector means further includes means requiring successive ones of said plurality of binary pulses to be spaced apart at least by a second predetermined time period in order for said output signal to be produced.

14. The apparatus of claim 13, wherein said second predetermined time period is greater than said fifth predetermined time period.

15. The apparatus of claim 1, wherein said detector means further comprises means for detecting a predetermined amount of physical movement of said unit and for providing a movement signal thereupon.

16. The apparatus of claim 15, wherein said detector means further comprises disable means for inhibiting the provision of said first signals to said signal processing means for a fourth predetermined time period when said movement signal occurs within a fifth predetermined time period after one of said binary pulses.

17. The apparatus of claim 16, wherein said disable means further inhibits the provision of said first signals to said signal processing means for said fourth predetermined time period when two consecutive binary pulses occur within said fifth predetermined time period.

18. Apparatus, which comprises:

a miniature electronic unit adapted be attached to a common article such as keys or eyeglasses and including means responsive to a plurality of human-generated sounds for emitting audible tones to enable the common article to be located, said means comprising:

(a) transducer means responsive to said sounds for generating first signals, and also responsive to second signals to generate said audible tones;

(b) signal processing means, connected to said transducer means, for providing a binary pulse when each of said first signals exceeds a preselected threshold level;

(c) detector means, connected to said signal processing means, for producing an output signal when a plurality of said binary pulses is received by said detector means within a first predetermined time period and consecutive binary pulses are spaced apart at least by a second predetermined time period;

(d) output means, connected to said detector means and said transducer means, for intermittently generating said second signals for a third predetermined time period upon receipt thereby of said output signal; and (e) battery-saver means for inhibiting the provision of said first signals to said signal processing means for a fourth predetermined time period when two consecutive of said binary pulses occur within a fifth predetermined time period.

19. The apparatus of claim 18, wherein said detector means further comprises means for detecting a predetermined amount of physical movement of said unit and for providing a movement signal thereupon.

20. The apparatus of claim 19, wherein said battery-saver means further inhibits the provision of said first signals to said signal processing means when said movement signal occurs within said fifth predetermined time period after one of said binary pulses.

21. The apparatus of claim 18, wherein said audible tones are of a preselected frequency.

22. The apparatus of claim 18, wherein said plurality of sounds is four.

23. The apparatus of claim 22, wherein said sounds comprise human hand claps.

24. The apparatus of claim 18, wherein said plurality of sounds comprise human hand claps.

25. The apparatus of claim 18, wherein the duration of said binary pulse is substantially equal to the period that said first signals exceed said threshold level.

26. The apparatus of claim 18, wherein said transducer means is responsive to said sounds within a predetermined frequency range.

27. The apparatus of claim 18, wherein said second predetermined time period is greater than said fifth predetermined time period.

28. Apparatus, which comprises:

a miniature battery-powered electronic unit adapted to be attached to a common article such as keys or eyeglasses and including means responsive to a plurality of human-generated sounds for emitting audible tones to enable the common article to be located, said means comprising:

(a) transducer means responsive to said sounds for generating first signals, and responsive to a second signal to generating said audible tones;

(b) signal processing means, connected to said transducer means, for providing a binary pulse when each of said first signals exceeds a preselected threshold level; and (c) detector means, connected to said signal processing means, for producing an output signal when a plurality of said binary pulses is received by said detector means within a first predetermined time period.

* * * * *

UNITED STATES PATENT AND TRADEMARK OFFICE

CERTIFICATE OF CORRECTION

PATENT NO. : 4,507,653

DATED : March 26, 1985

INVENTOR(S) : Edward B. Bayer

It is certified that error appears in the above—identified patent and that said Letters Patent is hereby corrected as shown below:

On the title page;

In the ABSTRACT, line 1, "battery-operated" should be -- battery-powered --.

Column 4, line 52, "greater" should be -- great --.

Column 5, line 25, "binayr" should be -- binary --.
line 62, "Curcuit" should be -- Circuit --.

Column 7, line 57, "pulses" should be -- pulse --.

Column 9, line 35, "inerting" should be -- inverting --.

Column 10, line 25, "fourth-four" should be -- fourty-four --.

Signed and Sealed this

*Twentieth* Day of *August 1985*

[SEAL]

*Attest:*

DONALD J. QUIGG

*Attesting Officer* *Acting Commissioner of Patents and Trademarks*